US007959093B2

(12) United States Patent
Payne

(10) Patent No.: US 7,959,093 B2
(45) Date of Patent: Jun. 14, 2011

(54) APPARATUS FOR APPLYING COLD-SPRAY TO SMALL DIAMETER BORES

(75) Inventor: David A. Payne, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 1529 days.

(21) Appl. No.: 11/348,862

(22) Filed: Feb. 7, 2006

(65) Prior Publication Data

US 2007/0181714 A1 Aug. 9, 2007

(51) Int. Cl.
*B05B 1/28* (2006.01)

(52) U.S. Cl. ..... 239/290; 239/298; 239/427.3; 239/430; 239/431; 239/543

(58) Field of Classification Search ..... 239/79, 239/85, 290–301, 433, 434, 434.5, 407, 412–416.2, 239/427, 427.3, 429–431, 543, 547; 118/302, 118/308

See application file for complete search history.

(56) References Cited

U.S. PATENT DOCUMENTS 2,504,805 A * 4/1950 Clipson ..... 427/427
2,924,489 A * 2/1960 Beckmann ..... 406/90
3,311,085 A 3/1967 Smith
3,333,774 A * 8/1967 Demaison ..... 239/335
3,422,795 A 1/1969 Smith
3,425,601 A * 2/1969 Fry ..... 406/130
4,666,083 A * 5/1987 Yie ..... 239/8
4,715,535 A 12/1987 Mulder
4,970,364 A 11/1990 Muller
5,018,910 A * 5/1991 Weiss ..... 406/144
5,196,049 A 3/1993 Coombs et al.
5,884,851 A * 3/1999 Colavito et al. ..... 239/591
6,283,386 B1 9/2001 Van Steenkiste et al.
6,348,687 B1 2/2002 Brockmann et al.
6,419,210 B1 7/2002 Low
6,444,259 B1 9/2002 Subramanian et al.
6,602,545 B1 8/2003 Shaikh et al.
6,675,766 B2 1/2004 Miyajima et al.
6,951,312 B2 * 10/2005 Casalmir et al. ..... 241/39
2002/0073982 A1 6/2002 Shaikh et al.
2003/0127047 A1 7/2003 Ainsworth et al.
2005/0173556 A1 * 8/2005 Kwok et al. ..... 239/79
2005/0252450 A1 11/2005 Kowalsky et al.

* cited by examiner

*Primary Examiner* — Jason J Boeckmann
(74) *Attorney, Agent, or Firm* — Ingrassia Fisher & Lorenz, P.C.

(57) ABSTRACT

A nozzle is provided for use during a process for cold-dynamic gas spraying a powder material onto a bore surface. In one embodiment, and by way of example only, the nozzle includes a tube and a coating. The tube is configured to direct the powder material to the bore surface and has an inner surface, an axial section, a radial section, and a bend. At least a portion of the inner surface of the axial section defines a converging/diverging flowpath, and the axial section and the radial section are disposed at a predetermined angle relative to one another and include the bend disposed therebetween. The coating is disposed on at least a portion of the tube inner surface and comprises a material to which the powder material does not adhere.

5 Claims, 3 Drawing Sheets

APPARATUS FOR APPLYING COLD-SPRAY TO SMALL DIAMETER BORES

TECHNICAL FIELD

The present invention relates to cold-spray processes and, more particularly, to a nozzle that may be used during a cold-spray process.

BACKGROUND

Cold gas-dynamic spraying (hereinafter "cold spraying") is a technique that is sometimes employed to form coatings of various materials on a substrate. In general, a cold spraying system uses a pressurized carrier gas to accelerate particles through a nozzle and toward a targeted surface. The cold spraying process is referred to as a "cold gas" process because the particles are mixed and sprayed at a temperature that is well below their melting point, and the particles are near ambient temperature when they impact with the targeted surface. Converted kinetic energy, rather than a high particle temperature, causes the particles to plastically deform, which in turn causes the particles to form a bond with the targeted surface. Bonding to the component surface occurs as a solid state process with insufficient thermal energy to transition the solid powders to molten droplets. Cold spraying techniques can therefore produce a wear or corrosion-resistant coating that strengthens and protects the component using a variety of materials that can not be applied using techniques that expose the materials and coatings to high temperatures.

The nozzle used for cold spraying is typically designed to receive particles that are sized between about 5 and about 50 microns and accelerated to supersonic speeds. In most cases, the nozzle is a straight, rectangular tube that defines a relatively straight flowpath along which the particles follow. The nozzle also typically includes an outlet through which the particles exit at a velocity ranging between 300 and 1200 m/s. To create a coating having optimal properties, the particles are preferably sprayed at a 90 degree angle relative to the component surface; thus, the nozzle is disposed at a substantially 90 degree angle relative to the surface during cold spraying as well.

Although conventionally designed nozzles are useful for cold spraying many different component surface configurations, they may not be as useful in certain circumstances. For example, the cold spray process may not be employed to repair worn surfaces of certain bores that are formed in a component. Specifically, the bore may have a diameter that is smaller than the length of the nozzle so that the nozzle may not be placed at a 90 degree angle relative to the bore surface.

Thus, there is a need for a nozzle that may be used with a cold spray system for repairing any surface of a component. More particularly, there is a need for a nozzle that can be used to repair a worn surface of a bore that may be formed in the component. Furthermore, other desirable features and characteristics of the present invention will become apparent from the subsequent detailed description of the invention and the appended claims, taken in conjunction with the accompanying drawings and this background of the invention.

BRIEF SUMMARY

The present invention provides a nozzle for use during a process for cold-dynamic gas spraying a powder material onto a bore surface.

In one embodiment, and by way of example only, the nozzle includes a tube and a coating. The tube is configured to direct the powder material to the bore surface and has an inner surface, an axial section, a radial section, and a bend. At least a portion of the inner surface of the axial section defines a converging/diverging flowpath, and the axial section and the radial section are disposed at a predetermined angle relative to one another and include the bend disposed therebetween. The coating is disposed on at least a portion of the tube inner surface and comprises a material to which the powder material does not adhere.

In another embodiment, and by way of example only, the nozzle includes a tube, an opening, and a gas jet. The tube is configured to direct the powder material to the bore surface and has an inner surface, an axial section, a radial section, and a bend. At least a portion of the inner surface of the axial section defines a converging/diverging flowpath, the axial section and the radial section is disposed at a predetermined angle relative to one another, and the bend is disposed between the axial and radial sections and includes an outer section. The opening is formed through the tube on the bend outer section. The gas jet is in communication with the opening and is configured to direct a stream of gas at a predetermined velocity and direction therethrough to divert the powder material traveling in an axial direction to a radial direction.

In still another embodiment, and by way of example only, the nozzle includes a tube, a deflector, and a coating. The tube is configured to direct the powder material to the bore surface and has an inlet, an outlet disposed substantially in alignment with the inlet, and a flowpath therebetween. The deflector is disposed proximate the tube outlet and is disposed at an angle relative to the flowpath to thereby divert a direction in which the powder material travels along the flowpath such that the powder material impinges the bore surface at an angle of about 90 degrees. The coating is disposed on at least a portion of the deflector, and comprises a material to which the powder material does not adhere.

Other independent features and advantages of the preferred nozzle will become apparent from the following detailed description, taken in conjunction with the accompanying drawings which illustrate, by way of example, the principles of the invention.

DETAILED DESCRIPTION OF A PREFERRED EMBODIMENT

Figure 1:
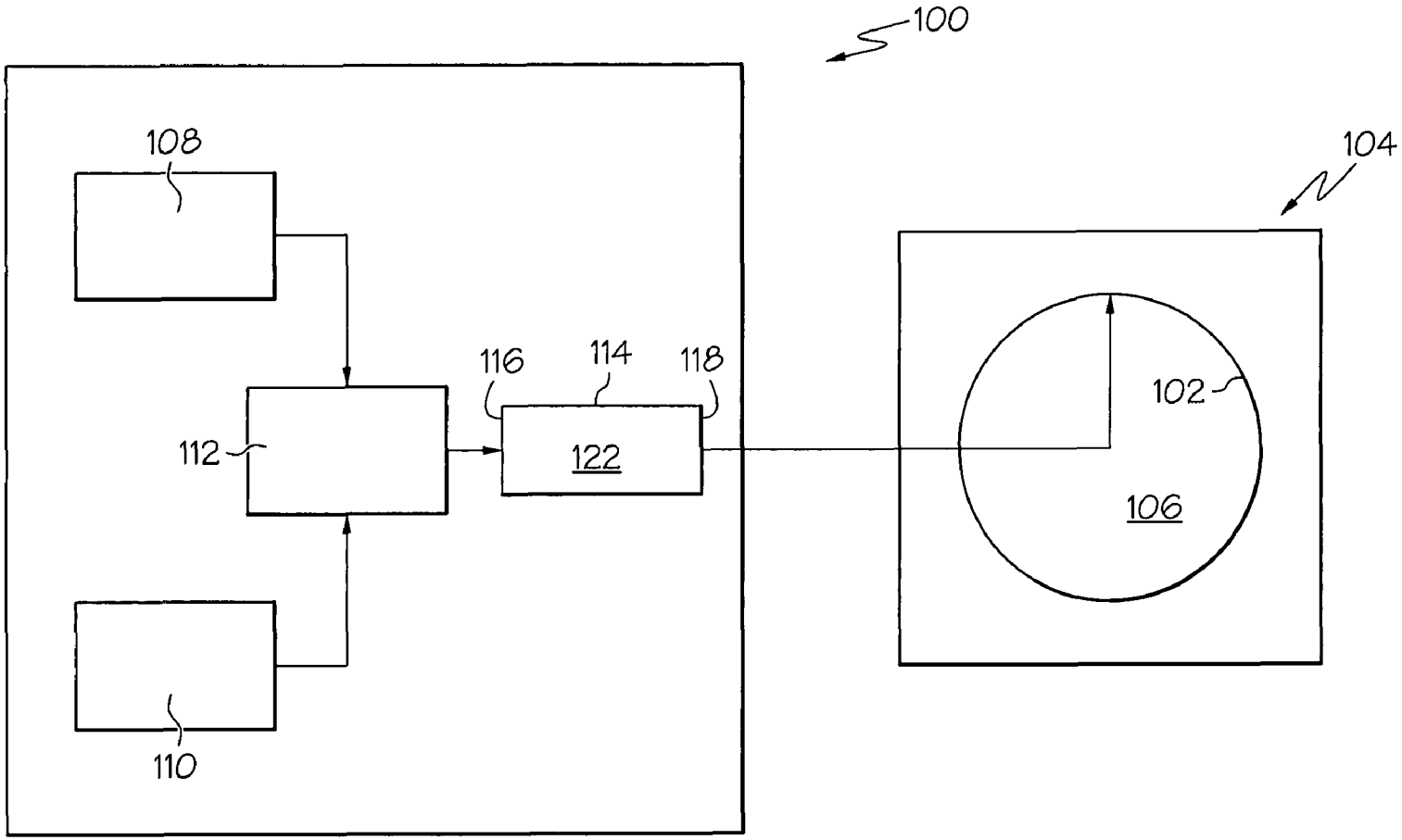
FIG. 1 is a schematic of an exemplary cold gas-dynamic spray system.

The following detailed description of the invention is merely exemplary in nature and is not intended to limit the invention or the application and uses of the invention. Furthermore, there is no intention to be bound by any theory presented in the preceding background of the invention or the following detailed description of the invention. It will be appreciated that like reference numerals represent like parts.

Turning now to FIG. 1, an exemplary cold gas-dynamic spray system 100 for use in a process to repair a worn surface 102 of a turbine engine component 104, in particular, to surfaces that define bores 106 formed in the components. The cold gas-dynamic spray system 100 is illustrated schematically and is a simplified example of a type of system that can be used to repair bores. Those skilled in the art will recognize that most typical implementations of cold gas-dynamic spray systems may include additional features and components. The cold gas-dynamic spray system 100 includes a powder feeder 108, a carrier gas supply 110 (typically including a heater), a mixing chamber 112, and a nozzle 114.

The powder feeder 108 is configured to provide any one or more of numerous conventional repair powder materials to the mixing chamber 112. It will be appreciated that although any one of numerous repair powder materials may be used, the selection of the repair powder material is dependent upon the particular material from which the worn component 104 is made. The carrier gas supply 110 also communicates with the mixing chamber 112 and supplies a suitably pressurized gas thereto. In instances in which two or more repair powder materials are used, the carrier gas supply 110 provide the gas for mixing the repair powder material in the mixing chamber 112.

The repair powder material is then accelerated through the nozzle 114 and at a target on the bore surface 102. The nozzle 114 is a tube configured to direct the repair powder material at the bore surface 102 at a substantially 90 degree angle relative thereto and includes an inlet 116, an outlet 118, and a flowpath 122, at least a portion of which is converging/diverging 123, extending therebetween. Preferably, a radial distance between the inlet 116 and outlet 118 is less than the diameter of the bore 106 to be repaired. In these regards, any one of numerous suitable configurations may be implemented.

Figure 2:
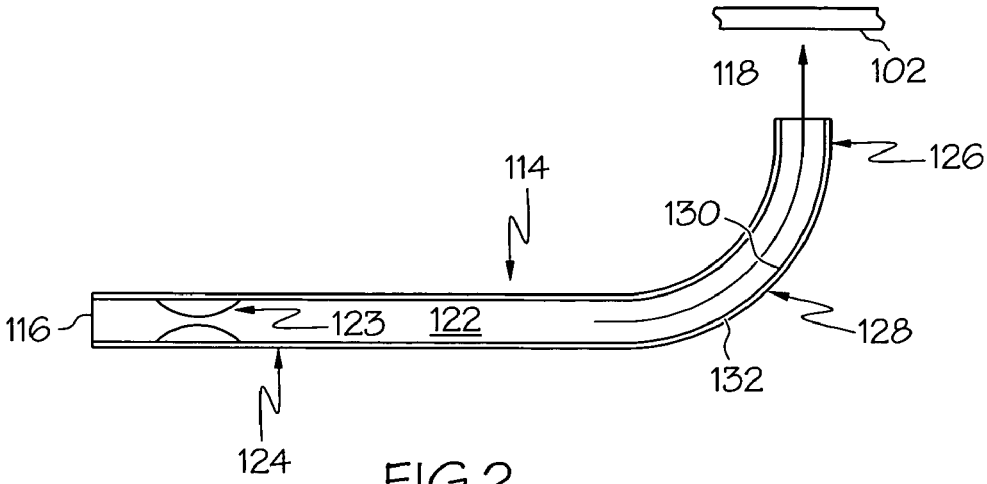
FIG. 2 is a simplified cross section view of an exemplary nozzle that may be used in the system depicted in FIG. 1.

In one exemplary embodiment, as shown in FIG. 2, the flowpath 122 is configured such that the repair powder material enters the inlet 116 in an axial direction and exits the outlet 118 in a radial direction. Here, the nozzle 114 includes an axial section 124, a radial section 126, a bend 128, and a coating 130. As shown in FIG. 2, the axial section 124 and radial section 126 are disposed at a substantially 90 degree angle relative to one another. To prevent the powder material from collecting in the bend 128, the coating 130 is preferably formed on the inner surface 132 of the bend 128. In other embodiments, the coating 130 may be formed on substantially all of the inner surface 132 of the nozzle 114. The coating 130 is preferably made of a material to which the repair powder material does not adhere. For example, elastomeric materials, such as silicone, polytetrafluoroethylene, rubber, latex, urethane, plastic and other similar materials may suitably be used. Additionally, the coating 130 material may be formulated to be more resistant to erosion than the material from which the nozzle 114 is constructed. Materials that may be employed include, but are not limited to ceramics, glass, nitride coatings, plating, and chrome.

Figure 3:
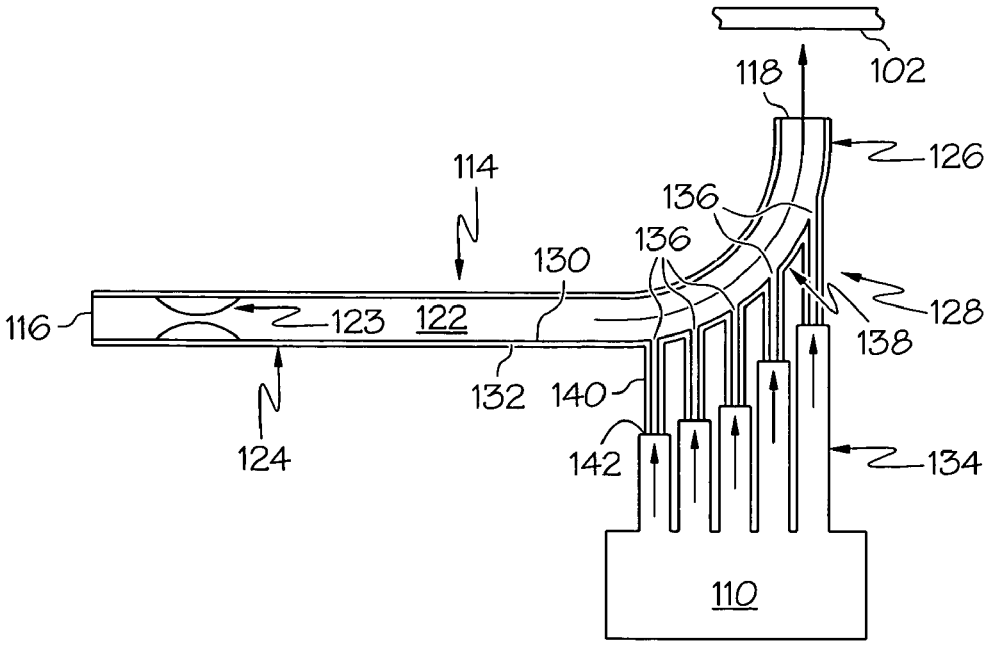
FIG. 3 is a simplified cross section view of another exemplary nozzle that may be used in the system depicted in FIG. 1.

In another exemplary embodiment, the powder material is directed through the bend 128 via a plurality of gas jets 134, as shown in FIG. 3. Specifically, the gas jets 134 are configured to inject gas into the flowpath 122 to thereby divert the flow of the powder material from a first direction to a second direction. For instance, the flow of the powder material is preferably redirected from the axial direction of the axial section 124 radially outwardly for travel through the radial section 126. In this regard, the gas jets 134 are coupled to a gas source, such as the carrier gas supply 110, or any other gas source, and disposed in communication with a plurality of openings 136 formed through an outer section 138 of the bend 128. In one exemplary embodiment, individual tubes 140 are coupled between outlets 142 of the gas jets 134 and each of the openings 136, as shown in FIG. 3, to provide direct flow paths along which the gas streams from the jets 134 may travel; however, it will be appreciated that in some embodiments, the tubes 140 may be omitted. Similar to the embodiment described above, the nozzle inner surface 132 here may also be coated with a coating 130.

Figure 4:
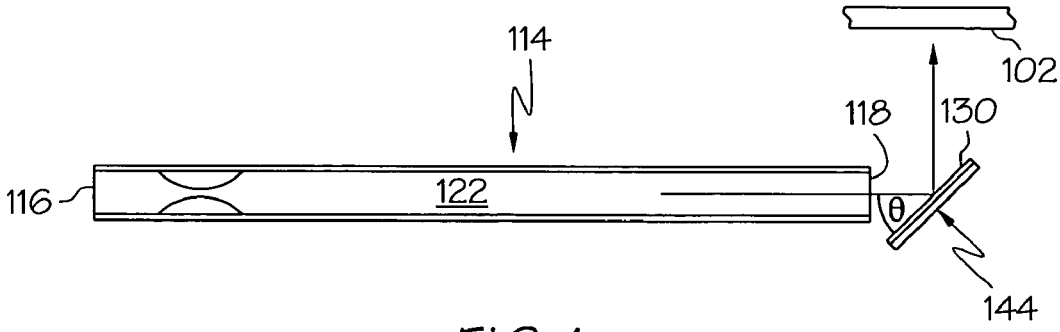
FIG. 4 is a simplified cross section view of still another exemplary nozzle that may be used in the system depicted in FIG. 1.

In still another exemplary embodiment, depicted in FIG. 4, the nozzle 114 is configured to direct the repair powder material to a deflector 144. In this embodiment, the nozzle inlet 116 and outlet 118 are substantially aligned with each other so that the repair powder material enters and exits the flowpath 122 in a substantially axial direction. The deflector 144 is disposed in communication with the nozzle outlet 118 to deflect the exiting repair powder material such that it impinges the bore surface 102 at a substantially 90 degree angle. In this regard, the deflector 144 is preferably disposed at an appropriate angle relative to the flow of the repair powder material. For example, in one embodiment, the deflector 144 is angled at about 45 degrees relative to the flow of the repair powder. To allow the powder material to properly deflect off of the deflector 144, a coating 130 may be included thereon. Just as described above, the coating 130 is preferably made of a material to which the repair powder material does not adhere and that may or may not be formulated to be more resistant to erosion than the material from which the component is constructed. Materials that may be employed include, but are not limited to ceramic, glass, metal, and chrome.

Figure 5:
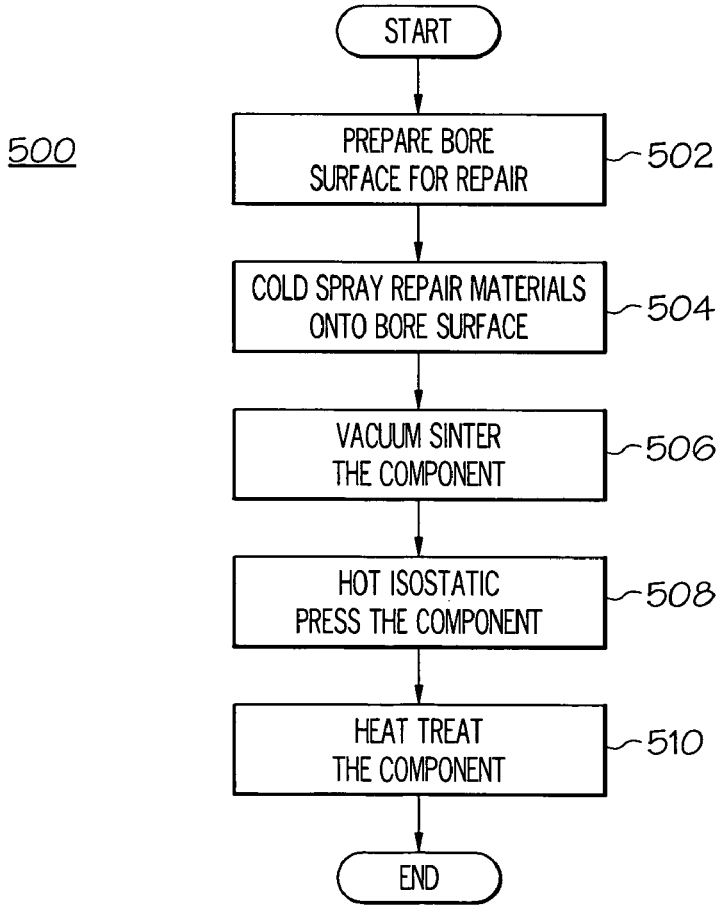
FIG. 5 is a flow diagram of an exemplary method for repairing a bore using the system depicted in FIG. 1.

In any case, the above-described system 100 may be used in an exemplary process 500, depicted in FIG. 5, for repairing the bore surface 102. First, a desired portion of the bore surface 102 is prepared for repair, step 502. The preparation of the bore surface 102 removes any oxidation and unwanted materials therefrom and prepares the surface 102 for the cold gas dynamic spray process. Any one of numerous suitable preparatory processes may be employed, such as, for example, pre-machining, degreasing and grit blasting.

Next, step 504, repair materials are cold sprayed onto the bore surface 102 using any one of the above-described exemplary cold gas-dynamic spray systems 100. As described above, in cold gas-dynamic spraying, particles at a temperature below their melting temperature are accelerated and directed to a target surface on the turbine component. When the particles strike the target surface, the kinetic energy of the particles is converted into plastic deformation of the particle, causing the particle to form a strong bond with the target surface.

Although the present embodiment is, for convenience of explanation, depicted and described as being implemented on a bore surface 102, it will be appreciated that the method 500 may be used on a variety of different components in a turbine engine. For example, it can be used to apply material to worn surfaces on turbine blades and vanes in general, and to blade tips, knife seals, leading/trailing edges, platform and z-notch edge shape of the shroud particular. In all these cases, the material can be added to the worn surfaces to return the component to its desired dimensions.

With the repair materials deposited to the component 104, in some embodiments of the method 500, the next step 506 is to perform a vacuum sintering. In vacuum sintering, the component is diffusion heat treated at high temperature in a vacuum for a period of time. The vacuum sintering can render the metallurgical bonding across splat interfaces through elemental diffusing processes. The vacuum sintering can also remove inter-particle micro-porosity, homogenize and consolidate the buildup via an atom diffusion mechanism. The thermal process parameters for the vacuum sintering would depend on the particular material of the component. As one example, the repaired components and repair materials include high strength nickel alloys and are heat treated at 2050 degrees F. to 2300 degrees F. for 2 to 4 hours, and more preferably at 2050 degrees F. to 2200 degrees F. However, in other embodiments of the method 500, the repaired components and repair materials may be made of materials such as aluminum or magnesium and may be subjected to lower temperatures or, alternatively, the component may not be sintered at all.

In still other embodiments of method 500, the component undergoes additional hot isostatic pressing, step 508. The hot isostatic pressing (commonly referred to as HIP) is a high temperature, high-pressure process. This process can be employed to fully consolidate the cold-sprayed buildup and eliminate defects like shrinkage and porosity (a common defect related to the cold-gas dynamic-spray process). Additionally, this process can strengthen the bonding between the buildup of repair materials and the underlying component, homogenize chemistries in the applied materials, and rejuvenate microstructures in the base superalloy. Overall mechanical properties such as elevated temperature tensile and stress rupture strengths of the component can thus be dramatically improved with the hot isostatic pressing.

In some embodiments, it may be desirable to perform a rapid cool following the HIP process to reduce the high-temperature solution heat treatment aftermath that could otherwise exist. For example, in the case of a nickel-based superalloy, rapid cool from the HIP temperature can comprise cooling at a rate of about 45 to 60 degrees F. per minute, from the HIP temperature to below 1200 degrees F., which is normally below the age temperature for such materials. One advantage of the rapid cool capability is that the component material and the repair material are retained in "solution treated condition", reducing the need for another solution treatment operation. In other words, the HIP followed by rapid cool can provide a combination of densification, homogenization and solution treat operation. Using this technique can thus eliminate the need for other heat treatment operations. It will be appreciated that in embodiments in which the component and repair material are made of aluminum or magnesium, the component may not undergo the HIP process.

In still yet another embodiment, the component may undergo still additional heat treatment, step 510. The heat treatment can provide a full restoration of the elevated-temperature properties of component. However, it will be appreciated that in some applications it may be desirable to omit the heat treatment if the restoration can be accomplished in any one of the previously described steps.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A nozzle for use during a process for cold-dynamic gas spraying a powder material onto a bore surface, the nozzle comprising:

a first tube configured to direct the powder material to the bore surface, the first tube having an inlet, an outlet, an inner surface, an axial section, a radial section, and a bend, the inlet providing an entry for the powder material into the axial section, the outlet providing an exit for the powder material out of the radial section, the axial section and the radial section disposed at a predetermined angle relative to one another, the bend disposed between the axial and radial sections and including an outer section, and at least a portion of the inner surface of the axial section defining a converging/diverging flowpath between the inlet and the bend;

a plurality of openings formed through the outer section of the bend of the first tube; and a gas jet in communication with each of the plurality of openings and configured to direct a stream of gas at a predetermined velocity and direction through each of the plurality of openings to divert the powder material traveling in an axial direction to a radial direction.

2. The nozzle of claim 1, further comprising a coating disposed on at least a portion of the first tube inner surface, the coating comprising a material to which the powder material does not adhere.

3. The nozzle of claim 2, wherein the coating comprises an elastomeric material.

4. The nozzle of claim 1, further comprising a second tube coupled between the gas jet and the opening, the second tube configured to provide a flowpath along which the stream of gas travels.

5. The nozzle of claim 1, wherein the predetermined angle is substantially 90 degrees.

* * * * *